United States Patent [19]

Quigley

[11] 4,039,066

[45] Aug. 2, 1977

[54] FORGERY-RESISTANT IMPACT PRINTING WITH MATRIX PRINTER

[75] Inventor: William D. Quigley, Nutley, N.J.

[73] Assignee: Sweda International, Inc., Pine Brook, N.J.

[21] Appl. No.: 603,478

[22] Filed: Aug. 11, 1975

Related U.S. Application Data

[63] Continuation of Ser. No. 440,374, Feb. 7, 1974, abandoned.

[51] Int. Cl.[2] ..... B41J 7/70

[52] U.S. Cl. ..... 197/1 R; 283/9 R

[58] Field of Search ..... 197/1 R; 283/1, 6, 8, 283/9; 35/35

[56] References Cited

U.S. PATENT DOCUMENTS

| | | | |
|---|---|---|---|
| 1,002,600 | 9/1911 | Morris et al. | 283/8 B |
| 2,243,284 | 5/1941 | Niece | 283/9 R |
| 2,350,893 | 6/1944 | Hofgaard | 197/1 R |
| 3,034,806 | 5/1962 | Squires | 283/1 R |
| 3,675,948 | 7/1972 | Wicker | 283/6 |
| 3,687,256 | 8/1972 | Jones | 197/1 R |
| 3,719,262 | 3/1973 | Taplin | 197/1 R |
| 3,814,227 | 6/1974 | Hurd et al. | 197/1 R |

*Primary Examiner*—Edward M. Coven

*Attorney, Agent, or Firm*—Robert F. Rotella; Norman Friedman

[57] ABSTRACT

A matrix printer and method for printing characters so as to reduce the likelihood of forgery by printing both the desired character and its complement on the same medium.

4 Claims, 3 Drawing Figures

FIG. 1
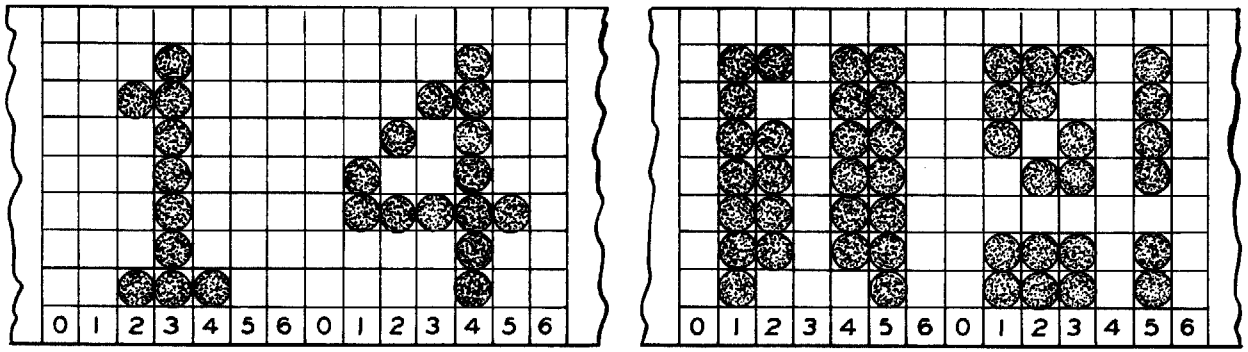
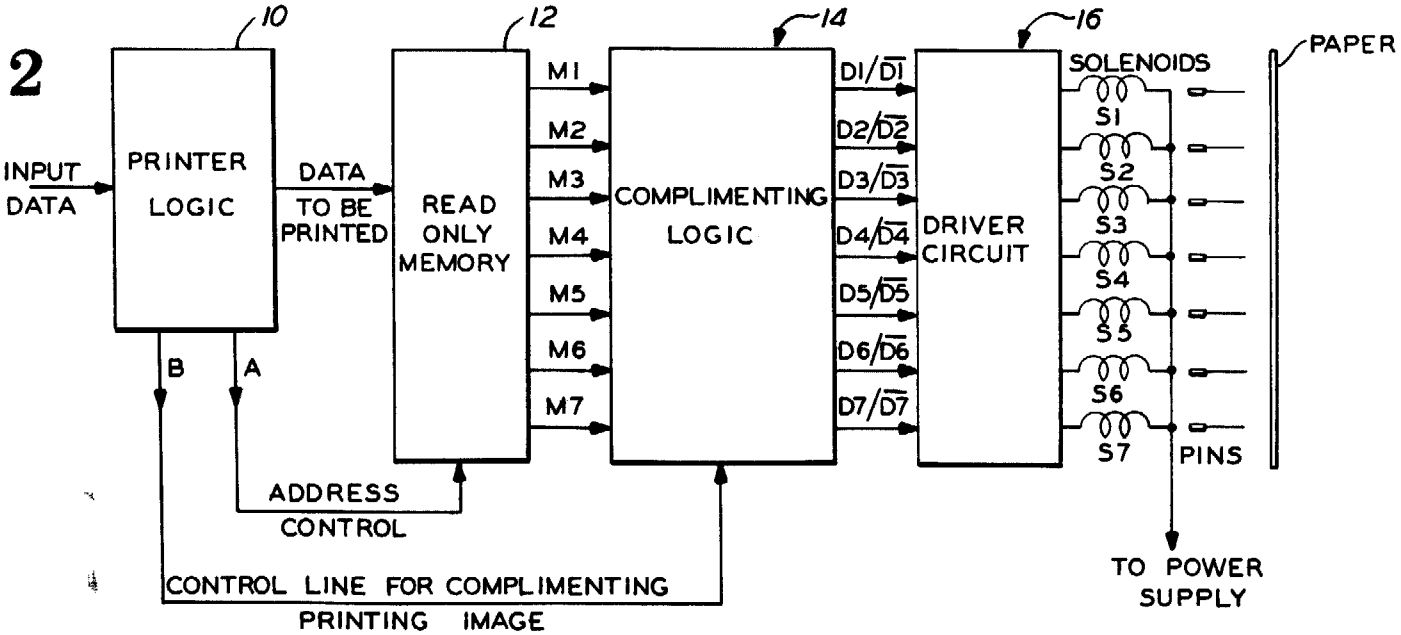
FIG. 2

FORGERY-RESISTANT IMPACT PRINTING WITH MATRIX PRINTER

This is a continuation of application Ser. No. 440,374, filed Feb. 7, 1974, now abandoned.

BACKGROUND OF THE INVENTION

In many situations the entry of data is of a "non-critical" nature. Such situations would be where a deliberate alteration or forgery would not result in any unlawful gain. In such non-critical situations, as in the printing of ledger statements for use within a company, or other similar situations, the normal entry of data on a medium such as paper would be "black on white" or any suitable contrasting color combination. However, in critical situations, double entry of data on the same instrument is commonly made in an attempt to prevent forgery on for example, checks or other negotiable instruments. Commonly the dollar amount a check is payable for is entered twice, sometimes both entries use arabic numerals, or one entry is in arabic numerals while the other is in words. Regardless of the precautions taken the ingenious forger is sometimes able to alter such data sufficiently to obtain an illegal gain.

SUMMARY OF THE INVENTION

It is, therefore, an object of this invention to provide an improved method of printing data which is less susceptible of alteration or forgery.

Another object of this invention is to provide an electro-mechanical system for providing a means for implementing such improved printing method.

A further object of this invention is to provide an improved electro-mechanical printing system having excellent forgery prevention output data printouts.

A still further object of this invention is to provide an improved system for printing out data in such form as to be less susceptible of causing reading error as well as alteration.

These and other objects of the invention are accomplished in the illustrative embodiment by providing a method of forgery resistant printing of characters on a medium which utilizes the steps of printing the desired character/s on the medium and also printing the complement of these same characters on the same medium. The inventive system for accomplishing such printing in this illustrative embodiment is achieved by providing a complimenting means for inverting that input data which is coupled thereto as well as providing a means for coupling said input data to said complimenting means.

BRIEF DESCRIPTION OF THE DRAWINGS

The invention is illustrated in the drawing of which:

FIG. 1 shows a dot matrix imprint which positively defines the numeral 14 side by side with a background dot matrix imprint which negatively defines the same numeral 14 in accordance with the present invention;

FIG. 2 is a simplified functional block diagram of a system incorporating the features of this invention.

DESCRIPTION OF THE INVENTION

Figure 3:
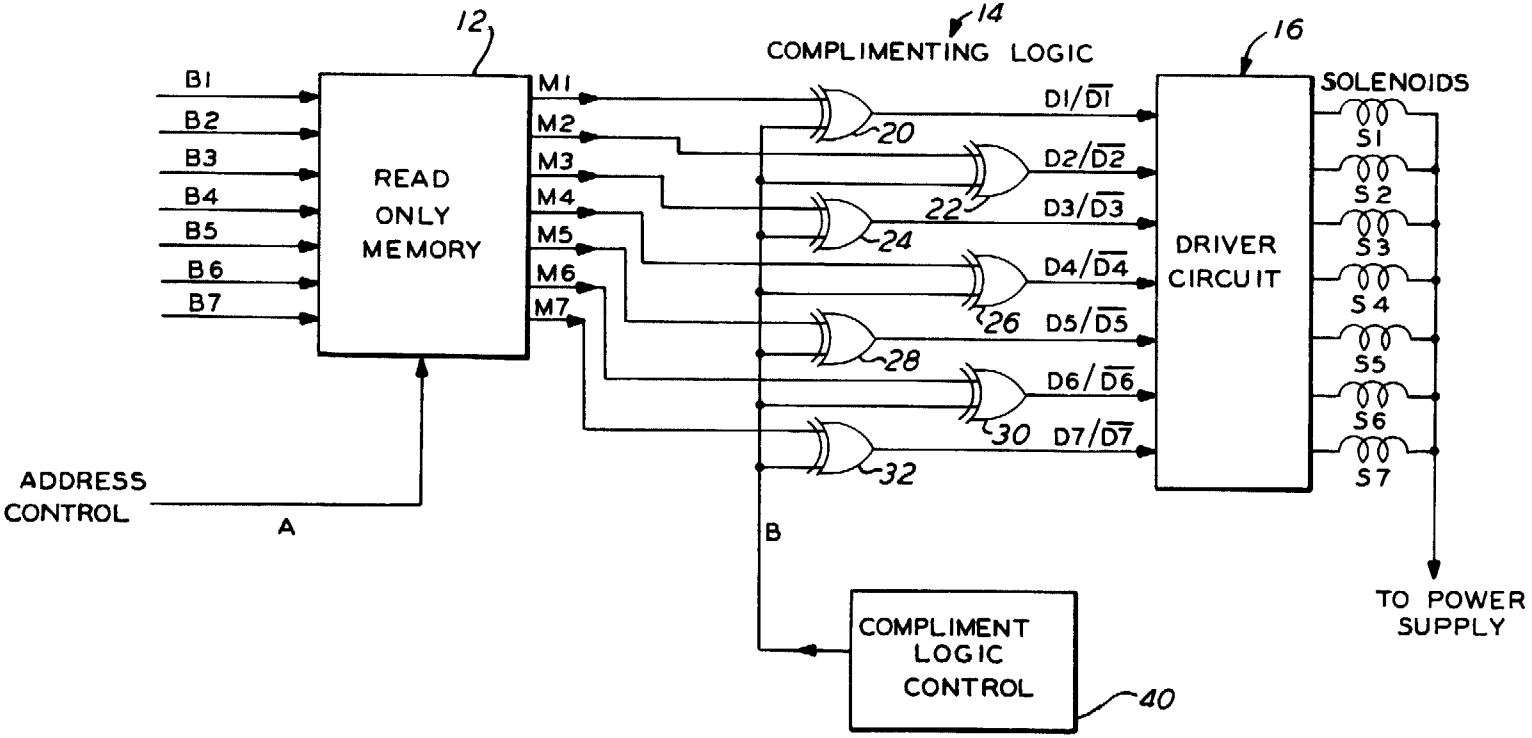
FIG. 3 is a partial, simplified functional block diagram of the invention illustrated in the embodiment of FIG. 2.

Referring now to the invention illustrated in the embodiment of FIG. 1 wherein the character, numeral 14, is depicted in its true and complement printed form in what is referred to as a 5 × 7 inches dot matrix. The true form of the character numeral 14, as may be seen from said figure, is composed of a matrix, seven units in height and five in width for each digit to be represented or printed as well as an appropriate spacing of two units between and in front of each digit. The particular black on white format depicted in the left side of said figure represents the number 14 utilizing the digits 1 and 4; each digit is formed by the printing of appropriate dots in the correct positions to form the proper character. In this embodiment a suitable dot matrix coil set, associated with the paper or other medium to be printed on, is energized so as to impact on the paper thereby forming a dot in the desired matrix position. Such matrix printers are conventional and will therefore not be described in any detail; they comprise a plurality of matrix coils in solenoid form around a dot printing head armature by means of which, when the associated solenoid is energized, the print head impacts on to the paper to form a dot.

Near the true representation of the character to be printed out, in this embodiment to the right of it, is what is referred to as the complement of the character to be printed out or the reverse image and which is similar to a photographic negative of the character. In this case the digit itself is depicted by the absence of a printed dot and which is surrounded by printed dots in the 5 × 7 matrix; this gives the effect of a "white on black" format. The complement of the character illustrated in the embodiment illustrated in FIG. 1 is only partially surrounded by printed dots; a greater contrast can be provided by printing additional dots in the spaces both above and below the periphery of the printed out character.

Referring now to FIG. 2 wherein is illustrated a system for providing forgery resistant printing, a control means comprising a printer logic circuit 10 is provided which has coupled to it, at its input, input data. The source of said input data is either a compiler, computer device, paper tape or other appropriate source of input data. The printer logic circuit 10 performs necessary control, in a conventional manner, on said input data, such as properly spacing the output printer carriage, line feeding, addressing other memory elements in the system, and for control of the complementing logic in the system. The output data to be printed is coupled from the printer logic circuit 10 to the input of a memory device also part of the control means, read only memory 12; this data to be printed is in an input code which is representative of a numeral or other character desired to be printed and is preferably in the USA Standard Code For Information Interchange, referred to hereinafter as "ASCII." The read only memory element 12 is a translator device or what may be referred to as a "look-up-table" which converts the input ASCII data into another code which is representative of the desired matrix dot pattern and which forms, when printed out, the shape of the character the code represents. The translated data or "matrix" data is outputed from the read only memory 12 via seven separate output data lines M1 through M7; seven data lines are used in this embodiment since a 5 × 7 matrix output print format is desired.

The read only memory 12 is controlled by the printer logic circuit 10 which properly addresses it over line A, in a conventional manner, so that the proper matrix data is continuously strobed out to form the proper character or numeral printout. In other words, this address control input successively determines which group of seven separate matrix data bits are outputed to the next stage, a character complementing means, complementing logic circuit 14. This complementing logic circuit 14, under the control of the printer logic circuit 10 over line B, is used to convert the matrix data on lines M1 through M7 into its complement when a δcomplement" printing image control signal is applied thereto, or will merely pass this matrix data therethrough without any change when a "true" printing image control signal is applied thereto, over seven data output lines of the complementing logic circuit 14. Each of these output data lines D1/$\overline{D1}$ through D7/$\overline{D7}$ are separately connected through the complementing logic circuit 14 to the respective input lines M1 through M7 of the complementing logic circuit 14. Each of the outputs of the complementing logic circuit 14 are also separately coupled to one of seven driver amplifier in a driver circuit 16 which functions to amplify all the input signals on each of the D1/$\overline{D1}$ through D7/$\overline{D7}$ lines so as to operate the associated output solenoids or matrix coil S1 through S7. When energized these solenoids S1 through S7 impacting their armature pins, to print, on the paper medium to form the desired character.

In summary, in operation the input data is fed to the printer logic 10 which in turn performs the necessary control on the input data. The data to be printed is coupled to the input of the read only memory 12 which translates this into another code representative of the desired matrix dot pattern of the character desired to be printed. This matrix data coupled over lines M1 through M7, for any given character, is fed into the complementing logic circuit 14, which under the control of the printer logic circuit 10 will first permit this matrix data to pass unaltered, and then complement this identical matix data subsequently fed to it. Thus true matrix data and then complement matrix data will be transmitted over output data lines D1/$\overline{D1}$ through D7/$\overline{D7}$. Said data will be coupled into the driver circuit 16 which will in turn energize the respective solenoids S1 through S7 to first print the desired portions of the character to be depicted and then its complement. The read only memory 12 is addressed by the printer logic circuit 10 over line A so as to strobe the correct bit matrix data information in the proper time sequence. Referring also now to FIG. 1, where it is depicted that during the printing of the true character digit one, only zero bits are generated on all the output lines M1 through M7 during time frame 1; at time frame 2 however, this changes so that one bits of information are now coupled on lines M2 and M7 to form the forward portion of the arabic numeral one. At time frame 3 all the lines M1 through M7 have a one bit of information thereon to form the vertical portion of the digit one, and at a time frame 4 only output line M7 has a one bit information to form the tail of the digit one.

Referring now to FIG. 3 wherein is illustrated as more detailed functional block diagram of the system used to provide such forgery resistant printing, the read only memory 12 has seven separate inputs thereto, B1 through B7, which memory functions to translate the data on said lines B1 through B7 into another code representative of the desired matrix dot pattern as described previously. Each of these seven input lines B1 through B7 to the read only memory 12 will carry bit data M ASCII code which is an input code representative of a numeral or character desired to be printed. For example, for the digit three according to the ASCII code, input lines B1 through B7 would have the following bit information thereon respectively, 1 1 0 0 on line B1 through B4 (representative of the digit) and 1 1 0 on lines B5 through B7 (representative of the column). The resulting output data from the read only memory 12 will be coupled over output data lines M1 through M7. Each bit of information on the M1 through M7 data lines is representative of a portion of the actual matrix dot pattern and which, together, forms, when printed out, the shape of the character the code represents, digit three. Each of these matrix output data lines M1 through M7 is coupled into one input of an exclusive OR circuit 20, 22, 24, 26, 28, 30 or 32 and all of said exclusive OR circuits have a control signal coupled over line B to their second input which control signal would be generated from a complement logic control circuit 40. This complement logic control circuit 40 is actually a part of the printer logic circuit 10 described with reference to FIGS. 1 and 2. Said complement logic control circuit 40 provides an output control signal, for example in the case where a true character output printout is desired a zero bit, but when a complemented character output printout is desired a one bit would be generated, all successively coupled to the second inputs of each of the exclusive OR gates 20 through 32. In the latter case this would of course result in an output at each of the exclusive OR gates which would be the complement of the input data signal on the first input lines of said exclusive OR circuits 20 through 32.

The output of each of the exclusive OR gates 20 through 32 are coupled to the drive circuit 16 which include a plurality of power amplifiers which when the proper form of input is coupled thereto will separately energize the associated individual output solenoids or S1 through S7 matrix coils associated therewith to operate its pin armature to impact in the proper place on the paper medium to form a portion of the desired character.

Obviously many modifications and variations of the present invention are possible in light of the above teachings. It is therefore to be understood that within the scope of the appended claims the invention may be practiced otherwise than specifically described.

What is claimed is:

1. A printing system comprising:

character complementing means having an input and output, for converting input data representative of a character coupled thereto, input means, for coupling said input data to said input of said character complementing means, control means, coupled to said input of said character complementing means, for selectively providing sequential control signals to said character complementing means, said character complementing means being capable of generating, under control of corresponding sequential control signals from said control means, signals representative of the complement of a character and the character itself, and printing means, coupled to the output of said character complementing means, for visually printing in the same form said input data both as a character and as the character's complement.

2. A printing system according to claim 1 wherein said printing means includes a matrix printer.

3. A printing system according to claim 2 additionally comprising:

a translating means, coupled to the input of said character complementing means, for transforming said input data representative of a character coupled thereto in the form of an input code representative of a character into an output code representative of the visual pattern of the character.

4. A printing system according to claim 3 wherein said translating device includes a read only memory having a plurality of inputs and outputs, and wherein said matrix printer include a plurality of matrix coils said character complementing means includes a plurality of exclusive OR gates having a first and second input and an output, the first of said inputs being coupled to one of said plurality of read only memory outputs and all the second inputs being coupled to said control means, and wherein each of said outputs from said exclusive OR gates are coupled to one of the matrix coils of said matrix printer.

* * * * *